US007897034B2

(12) United States Patent
De Oliveira et al.

(10) Patent No.: US 7,897,034 B2
(45) Date of Patent: Mar. 1, 2011

(54) AVIATION GASOLINE FORMULATION

(75) Inventors: Edimilson Jesus De Oliveira, Niterói (BR); Mauro Iurk Rocha, Niterói (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 1336 days.

(21) Appl. No.: 11/094,178

(22) Filed: Mar. 31, 2005

(65) Prior Publication Data

US 2006/0086040 A1 Apr. 27, 2006

(30) Foreign Application Priority Data

Oct. 22, 2004 (BR) ..... 0404605

(51) Int. Cl.
*C10L 1/06* (2006.01)
*C10L 1/16* (2006.01)

(52) U.S. Cl. ..... 208/17; 208/15; 208/16; 585/14; 44/412; 44/451; 44/448; 44/449

(58) Field of Classification Search ..... 44/412, 44/451, 448, 449; 208/15, 16, 17; 585/14
See application file for complete search history.

(56) References Cited

U.S. PATENT DOCUMENTS 3,212,867 A * 10/1965 Ockerbloom ..... 44/401
5,470,358 A 11/1995 Gaughan
5,851,241 A * 12/1998 Studzinski et al. ..... 44/359
6,238,446 B1 5/2001 Henderson
6,258,134 B1 7/2001 Studzinski et al.
6,451,075 B1 9/2002 Schoppe et al.
6,767,372 B2 * 7/2004 Barnes et al. ..... 44/300
2003/0183554 A1 * 10/2003 Bazzani et al. ..... 208/16

FOREIGN PATENT DOCUMENTS

WO WO 0240620 A2 * 5/2002

* cited by examiner

*Primary Examiner*—Ellen M McAvoy
*Assistant Examiner*—Pamela Weiss
(74) *Attorney, Agent, or Firm*—Sughrue Mion, PLLC

(57) ABSTRACT

An aviation gasoline (Avgas) formulation free from tetraethyl lead (TEL) for piston driven aircraft is described, the formulation comprising, in volume percent, between 0 and 65.2 base alkylate, between 0 and 50 super-alkylate, between 0 and 25 toluene, between 2 and 10 of a toluidine isomer blend, between 0 and 5 ethyl alcohol, between 0 and 25 $C_5$ cut and between 0 and 10 triptane. The formulations are prepared by admixing the components, with the order of mixing being from the denser to the less dense, except in the case of the toluidine isomer blend, which in spite of being the denser product is the latest to be added to the other streams in order to by-pass homogenization problems.

3 Claims, 2 Drawing Sheets

AVIATION GASOLINE FORMULATION

FIELD OF THE INVENTION

The present invention relates to the field of the hydrocarbon compositions for use as fuels, more specifically, to unleaded aviation gasoline formulations for piston driven aircraft, which require high octane fuel.

BACKGROUND INFORMATION

In view of the increasing demand from environmental regulations, banning tetraethyl lead (TEL) from aviation gasoline (Avgas) formulations is a question of time.

Thus, several companies and research groups are presently involved in projects aiming at providing fuel formulations having a performance similar to those using TEL.

Such endeavor is not an easy task since such product should be endowed with special features among which high octane rating, stability and high performance are among the most important items required for the new product.

Alternative formulations described in the literature employ oxygenated compounds (ethyl tert-butyl ether—ETBE, ethyl alcohol) and aromatic amines, chiefly meta-toluidine (m-Tol) as components of the new fuels, all of them still being developed or tested and none of them being yet commercially available.

Aviation gasoline fuels are mainly used in small passenger aircraft for leisure activities and also in small piston driven helicopters.

Because of the limited consuming market, aviation gasoline is produced in few refineries where the required stringent specifications are met without affecting too much the overall refinery budget.

The development of a specific aviation gasoline fuel started in 1930. At that time the air sector of the US Army specified a combat gasoline fuel having a minimum octane number requirement of 87. This is believed to be the first time the anti-knocking properties of an aviation gasoline fuel were defined in terms of octane number. In the beginning of Second World War fuels were similar to those of present class 100.

Aviation gasoline attained its development peak during Second World War. In 1944, the US Army issued a specification for class 115/145. Such fuel had the highest anti-knocking evaluation among all commercial aviation gasoline and was used to obtain maximum response of high performance engines.

Useful streams for this kind of fuel should have a narrow distillation range and high octane numbers. $C_5$ and $C_6$ isoparaffin cuts—those being used in small concentrations due to their high volatility—or alkylates are generally sought for these formulations.

Suitable additives are frequently the same as those used in jet engine fuels. However, the use of tetraethyl lead (TEL) is specific for aviation gasoline fuels. The use of this additive is specified in ASTM Method D 910 and the amounts are a function of the fuel class. Maximum allowed levels are 0.14 g/L, 1.12 g/L, and 0.56 g/L, respectively for 80/87, 100/130, and 100/130 LL classes. The only difference between the last two gasoline fuels is color and lead amount, with LL having the meaning of low lead.

According to several fuel experts, for economic reasons the consumption of gasoline fuel for light aviation (100 LL gasoline fuel) can be suppressed in the next years. Without a substitute, many aircraft will no longer be able to fly. The main reason for this concern is the quick decline in other TEL applications and a corresponding drop in the supply.

A few years ago there were nearly 40-50 TEL suppliers while nowadays only two are left, one in the United Kingdom and another one in Russia.

In spite of the research under course, at this moment there is no unleaded additive for Avgas.

In spite of the rather modest contribution of Avgas for lead pollution, there is a huge concern of environmental agencies for banning such lead source from the atmosphere.

Lead-related additives constitute a further problem.

Ethylene dibromide, another cleaning additive used with TEL in 100 LL gasoline fuel, is highly toxic and should also be banned since it is a chemical product leading to the greenhouse effect. Without this cleaning additive, lead can block the engine in a few hours.

Low consumption, soaring prices, added to the pressure from environmental agencies are parameters that tend to cause the end of leaded Avgas around 2005-2010. The same reasons make the basis for the research of a new product for an unleaded gasoline fuel.

The patent literature teaches a few low lead or unleaded Avgas formulations.

U.S. Pat. No. 6,767,372 discloses an aviation gasoline (Avgas) fuel composition possessing a high motor octane number containing reduced amounts of tetraethyl lead. The Avgas composition preferably comprises about 20 to about 80 vol % iso-octane, about 5 to about 18 vol % toluene, about 1 to about 20 vol % $C_4$ to $C_5$ paraffins, about 0 to about 1 mL/gallon tetraethyl lead (TEL) and the balance light alkylate. The Avgas composition may be economically produced utilizing spare methyl tertiary butyl ether plant capacity to produce iso-octane as one component of the composition.

U.S. Pat. No. 6,451,075 relates to a particularly useful low lead aviation gasoline fuel blend that complies with all requirements of ASTM D 910 and includes 67.0 volume % isooctane, 18.0 volume % xylene, 12.0 volume % isopentane, 3.0 volume % isobutane and 0.47 mL/gal of tetraethyl lead. Another useful low lead aviation gasoline fuel blend which complies with all requirements of ASTM D 910 except for oxygenate content includes 60.0 volume % isooctane, 15.0 volume % xylene, 14.0 volume % methyl t-butyl ether, 8.0 volume % isopentane, 3.0 volume % isobutane and 0.2 mL/gal tetraethyl lead. The isooctane used in either case is a purified isooctane prepared either by fractionating a crude DIB (diisobutylene) material and hydrogenating the fractionated material or hydrogenating the crude DIB material and fractionating the hydrogenated material.

U.S. Pat. No. 6,258,134 and U.S. Pat. No. 5,851,241 relate to aviation fuel compositions that contain a substantially positive or synergistic combination of an alkyl tertiary butyl ether, an aromatic amine and, optionally, a manganese component. The base fuel containing the additive combination may be a wide boiling range alkylate. MON is at least 91, and is raised to at least 94 by the addition of the cited components.

U.S. Pat. No. 6,238,446 teaches unleaded aviation gasoline having heats of combustion and octane rating deemed necessary for use under actual service conditions that are formed from blends of specific proportions of aviation alkylate, ether blending agent, a cyclopentadienyl manganese tricarbonyl and optionally other appropriate hydrocarbons falling in the gasoline boiling range.

U.S. Pat. No. 5,470,358 relates to an unleaded aviation gasoline fuel, containing additives such as aromatic amines substituted with $C_1$-$C_{10}$ alkyl or halogen, where the alkyl substituent cannot occupy the 2- or 6-position in the phenyl ring. According to this document, Avgas, due to stringent requirements in terms of octane rating and stability, is a blend of isopentane, alkylate, toluene and TEL. A base fuel useful as Avgas without octane booster such as TEL has a MON rate of 90 to 93. MON, and not RON, is the accepted parameter for the Avgas octane and is measured using the ASTM Method 2700-92. The additive is used in amounts from 6 to 10 wt %, if necessary with the aid of a co-solvent.

However, in spite of the present developments, the technique still needs an alkylate-based unleaded Avgas formulation, which contains triptane (2,2,3-trimethyl butane) associated to toluidine and super-alkylate in suitable proportions to lead to an Avgas having suitable properties, such Avgas formulation being described and claimed in the present application.

SUMMARY OF THE INVENTION

Broadly, the invention relates to an unleaded Avgas formulation for piston driven aircraft, which comprises, by volume, between 0 and 65.2% base alkylate, between 0 and 50% super-alkylate, between 0 and 25% toluene, between 2 and 10% toluidine, between 0 and 5% ethyl alcohol, between 0 and 25% $C_5$ stream and between 0 and 10% triptane.

Therefore, the invention provides an unleaded Avgas formulation useful for piston driven aircraft.

The invention provides further an unleaded Avgas formulation where the octane boosters include super-alkylate, triptane and a blend of toluidine isomers.

DETAILED DESCRIPTION OF THE PREFERRED MODES

Therefore, the present invention deals with an unleaded Avgas formulation for piston driven aircraft.

By volume, the formulation includes between 0 and 65.2% base alkylate, between 0 and 50% super-alkylate, between 0 and 25% toluene, between 2 and 10% of a toluidine isomer blend, between 0 and 5% ethyl alcohol, between 0 and 25% $C_5$ and between 0 and 10% triptane.

Volume proportions of some preferred formulations are for example as in Table 1 below.

TABLE 1

| COMPONENTS | % vol/vol |
|---|---|
| Alkylate | 12-18 |
| Super Alkylate | 28-42 |
| Toluene | 20-30 |
| Toluidines | 3-5 |
| Ethyl alcohol | 0-5 |
| $C_5$ stream | 10-20 |
| Triptane | 0-10 |

Base alkylate is a product obtained by the alkylation process of the petroleum industry whereby a stream, generally formed by isobutane and cis/trans 2-butene reacts under conditions of acidic catalysis, to yield poly branched hydrocarbons in the gasoline boiling range (alkylate) the major fractions of which contains 8 carbon atoms. Gasoline fuel obtained by this process has an excellent quality in terms of octane number and oxidation stability besides complying with several environmental requirements that are being progressively implemented aiming at modifying gasoline composition so that it is less harmful to man and environment.

Figure 1:
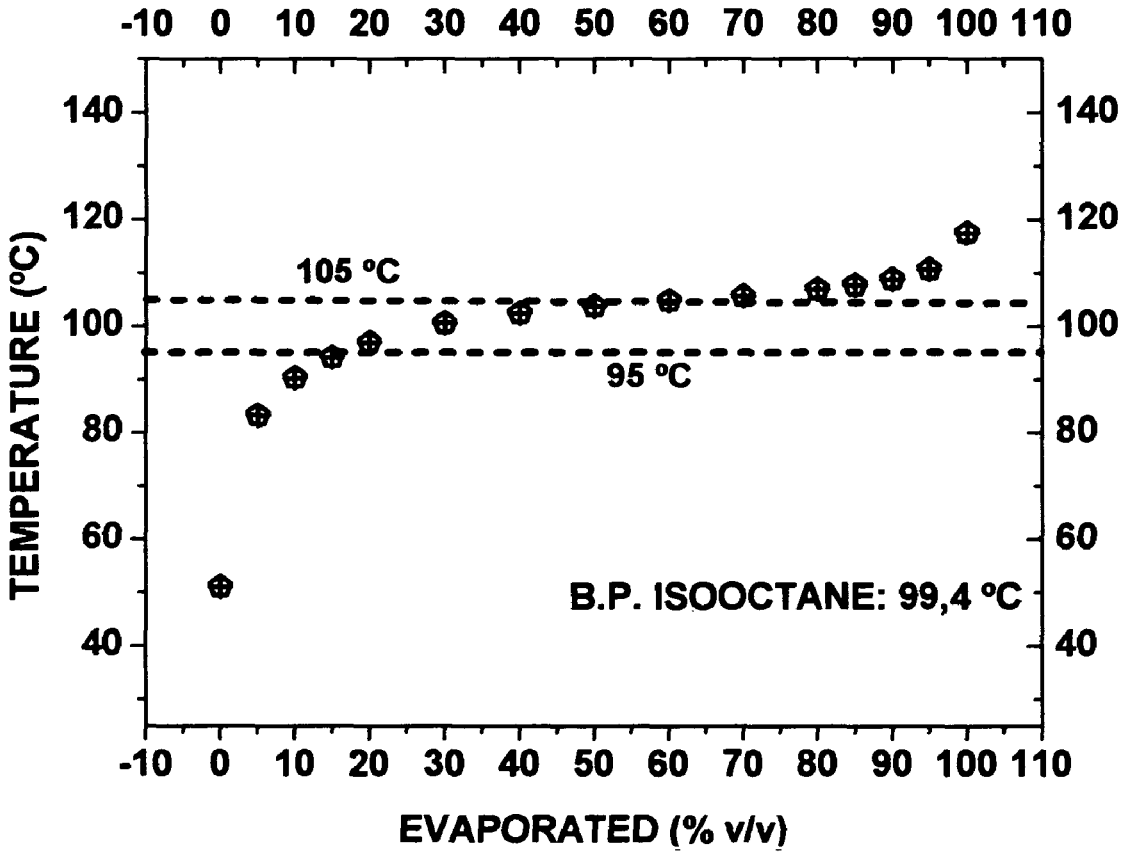
FIG. 1 attached is a graph illustrating the volume proportion of the evaporated from an alkylate feed to obtain super-alkylate.

Super-alkylate means, in the present invention, a distillation cut of the base alkylate containing between 75% and 78% by volume of isooctane. Such cut works as an octane booster for the Avgas formulation. The superalkylate is a stream obtained by the fractioning of the base alkylate. The range of interest is between 95° C. and 105° C. since the boiling point of isooctane is 99.4° C. The way to obtain super alkylate is depicted in FIG. 1.

Other physical properties of alkylate and super alkylate can be found in Table 2 below.

TABLE 2

| | | | Stream | |
|---|---|---|---|---|
| Feature | Unit | Method | Alkylate | Superalkylate |
| RON | — | ASTM D-2699 | 94.4 | 100.6 |
| MON | — | ASTM D-2700 | 93.5 | 96.5– |
| Density@ 20/4° C. | — | ASTM D-4052 | 0.6919 | 0.7008 |

According to the invention, useful toluidines are a blend of toluidine isomers in any amount. Although the literature mentions chiefly m-toluidine as octane booster, the Applicant has experimentally determined that isomer blends can be used, this representing an economic advantage.

Triptane is an octane booster, 2,2,3-trimethyl butane.

Toluene is commercial toluene.

$C_5$ is a refinery cut having boiling point between 35.5° C. and 48° C.

As regards the method to prepare the formulations according to the invention, the order of blending the components should be from the denser to the less dense, except in the case of m-Tol, which in spite of being the denser product is the latest to be mixed to the other streams. This is due to homogenization problems experienced by m-Tol.

Figure 2:
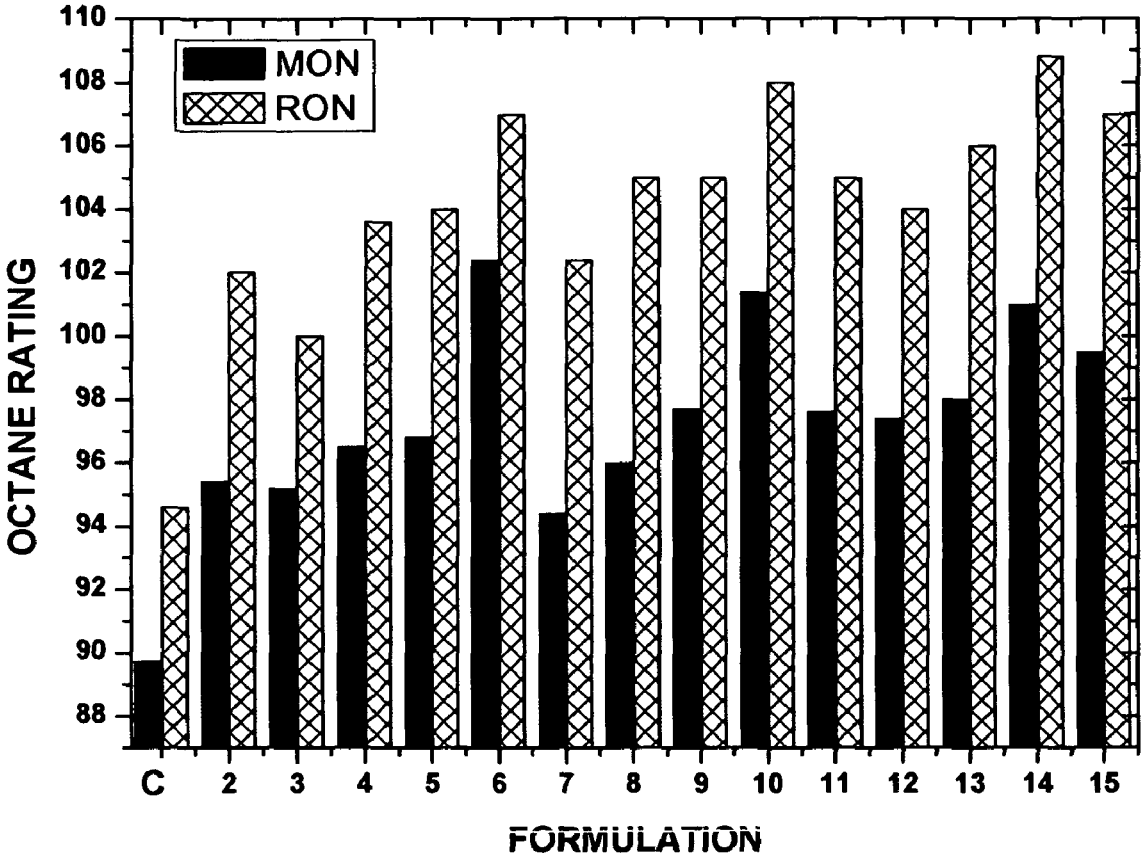
FIG. 2 attached is a bar chart showing the MON and RON values for several unleaded Avgas formulations. C is for Control, a state-of-the-art formulation.

The bar chart of FIG. 2 illustrates the formulations used in the Examples listed in Tables 3 and 4 below. In this chart, the symbol C in the abscissa means Control.

The invention will now be illustrated by the following non-limiting Examples according to Tables 3 and 4 below,

TABLE 3

| Formulation | Alkylate | Super Alkylate | Toluene | Toluidines | Ethyl alcohol | $C_5$ Stream | Triptane |
|---|---|---|---|---|---|---|---|
| | % vol/vol | | | | | | |
| Control | 65.0 | 0.0 | 15.0 | 0.0 | 0.0 | 20.0 | 0.0 |
| 2 | 65.2 | 0.0 | 15.0 | 3.0 | 0.0 | 16.8 | 0.0 |
| 3 | 17.3 | 33.1 | 25.0 | 3.0 | 5.0 | 16.6 | 0.0 |
| 4 | 17.0 | 40.0 | 23.5 | 3.0 | 0.0 | 16.5 | 0.0 |
| 5 | 0.0 | 50.0 | 25.0 | 4.0 | 0.0 | 21.0 | 0.0 |
| 6 | 40.0 | 50.0 | 0.0 | 10.0 | 0.0 | 0.0 | 0.0 |
| 7 | 8.0 | 47.0 | 20.0 | 3.0 | 0.0 | 22.0 | 0.0 |
| 8 | 15.0 | 35.0 | 25.0 | 4.0 | 0.0 | 21.0 | 0.0 |
| 9 | 16.0 | 50.0 | 15.0 | 4.0 | 0.0 | 15.0 | 0.0 |
| 10 | 24.2 | 50.0 | 10.0 | 6.0 | 0.0 | 9.8 | 0.0 |
| 11 | 15.0 | 35.5 | 25.0 | 3.5 | 0.0 | 21.0 | 0.0 |
| 12 | 16.0 | 40.0 | 15.0 | 4.0 | 0.0 | 25.0 | 0.0 |
| 13 | 0.0 | 45.0 | 25.0 | 4.0 | 0.0 | 21.0 | 5.0 |
| 14 | 0.0 | 40.0 | 25.0 | 4.0 | 0.0 | 21.0 | 10.0 |
| 15 | 10.0 | 35.0 | 23.0 | 4.0 | 0.0 | 21.0 | 7.0 |

TABLE 4

| Formulation | MON | RON |
|---|---|---|
| Control | 89.7 | 94.6 |
| 2 | 95.4 | 102 |
| 3 | 95.2 | 100 |
| 4 | 96.5 | 103.6 |
| 5 | 96.8 | 104 |
| 6 | 102.4 | 107 |
| 7 | 94.4 | 102.4 |
| 8 | 96 | 105 |
| 9 | 97.7 | 105 |
| 10 | 101.4 | 108 |
| 11 | 97.6 | 105 |
| 12 | 97.4 | 104 |
| 13 | 98 | 106 |
| 14 | 101 | 108.8 |
| 15 | 99.5 | 107 |

As illustrated by the bar chart of FIG. 2 and Tables 3 and 4 above, it should be pointed out that:

As expected, the addition of toluidines (isomer blend) neatly increases values for a certain formulation;

Formulations containing triptane and super alkylate attain high MON values even for reduced amounts of toluidines;

The presence of ethyl alcohol in a formulation does not seem to have any effect at least in the amount used. The use of ethyl alcohol can be considered in alternative/optional formulations since this compound is attractive under environmental considerations besides being an octane booster. However employing ethyl alcohol in a formulation designed for an aircraft should be cautiously thought of since such fuel can show phase separation, water absorption and freeze at the altitude level of aircraft fly.

In conclusion, the proposed formulations state that it is possible to obtain high MON levels for an unleaded Avgas, the booster effect being obtained by including specified amounts of a high isooctane cut such as super-alkylate, besides triptane and relatively reduced contents of toluidine isomer blends.

We claim:

1. An alkylated-base unleaded aviation gasoline (Avgas) formulation for piston driven aircraft, wherein said formulation consists of, in percent volume, between 12 and 18 base alkylate, between 28 and 42 super-alkylate, between 20 and 30 toluene, between 3 and 5 toluidine isomer blend, between 0 and 5 ethyl alcohol, between 10 and 20 $C_5$ cut, and between 5 and 10 triptane, all components at amounts adding up to a total of 100%, wherein the formulation has a motor octane number not less than 94.4, the super-alkylate is a distillation cut of the base alkylate containing between 75 and 78% by volume isooctane, and the $C_5$ cut has a boiling point between 35.5° C. and 48° C.

2. An alkylated-base unleaded aviation gasoline formulation according to claim 1, wherein the formulation is prepared so that its motor octane number (MON) is 102.4.

3. An alkylated-base unleaded aviation gasoline formulation according to claim 1, wherein the formulation leads to the specification of 100/130 classes of gasoline fuel for light aviation.

* * * * *